United States Patent [19]

Henderson

[11] Patent Number: 4,977,941

[45] Date of Patent: Dec. 18, 1990

[54] BINGO BAG WITH SELF-SUPPORTING VERTICAL WALL

[76] Inventor: Esther L. Henderson, 3399 Ludlow Circle, Amelia, Ohio 45102

[21] Appl. No.: 495,636

[22] Filed: Mar. 19, 1990

[51] Int. Cl.[5] ..... A45C 3/06; B65D 33/02

[52] U.S. Cl. ..... 150/112; 150/118; 150/129; 206/315.1; 273/148 R; 383/2; 383/39; 383/72; 383/104; 383/109; 383/119

[58] Field of Search ..... 206/315.1; 383/38, 2, 383/40, 99, 104, 109, 84, 117, 86, 110, 71, 72, 39; 150/112, 119, 118, 129, 130; 224/901; 190/107; 273/148 R, 239, 269

[56] References Cited

U.S. PATENT DOCUMENTS

| | | | |
|---|---|---|---|
| 1,056,218 | 3/1913 | Sahl | 383/40 |
| 1,170,448 | 2/1916 | Jennings | 383/117 X |
| 1,681,922 | 8/1928 | Boch | 383/39 |
| 2,177,906 | 10/1939 | Miller | 383/40 X |
| 2,335,359 | 11/1943 | Rosenberg | 383/72 X |
| 2,792,043 | 5/1957 | McLean | 150/118 |
| 3,550,663 | 12/1970 | Johnston | 383/109 X |
| 3,743,172 | 7/1973 | Ackley et al. | 383/104 |
| 3,746,066 | 7/1973 | McIntyre | 383/2 X |
| 3,813,017 | 5/1974 | Pimsleur | 224/901 X |
| 3,871,519 | 3/1975 | Groomes | 206/315.1 |
| 4,578,814 | 3/1986 | Skamser | 383/99 |
| 4,643,426 | 2/1987 | Adams | 273/148 R |
| 4,646,804 | 3/1987 | Damiano | 150/112 |
| 4,761,008 | 8/1988 | Huggins | 273/148 R |

*Primary Examiner*—Bryon P. Gehman

*Attorney, Agent, or Firm*—Wood, Herron & Evans

[57] ABSTRACT

A bingo bag is formed by quilt material sewed into a hollow container that is open at its upper end. Fabric is stitched to the inner surface of the container to form a plurality of pockets. The quilt material is stiff enough that the bag sits in an upright position making accessible the interior of the bag where bingo-playing accessories are kept.

8 Claims, 2 Drawing Sheets

BINGO BAG WITH SELF-SUPPORTING VERTICAL WALL

BACKGROUND OF THE INVENTION

This invention relates to a bingo bag, and particularly to a bag especially adapted to keep bingo-playing accessories organized and easily accessible. The bingo bag is useful in a rather sophisticated form of the well known game of bingo.

The game is played with two different media. First, conventional chipboard cards (hard cards) have five columns headed by the word "BINGO." Each of the five columns has five squares for numbers 1 to 15 in the first column, 16 to 30 in the second column, etc. As numbers are called by the caller, such as B-11, N-44, G-46, etc., the player places a small chip or marker on any square that corresponds to the number called. The markers have a ferromagnetic substance in them. For example, the marker or chip is in the form of a disk having an annular groove in its edge. A thin steel wire is laid in that groove. A skilled player might play as many as thirty cards at one time. At the completion of a called game, all chips must be removed from all cards. Picking so many chips up by hand is laborious, and as a consequence the skilled bingo player carries a wand having a magnet in its end. The magnet attracts all of the chips having the steel wire or other ferromagnetic substance. The chips are slid off the wand into a small chip container.

Second, the game is played with paper boards. One sheet of paper has four or nine games on it. Each of the games is set up as described above with the "BINGO" heading and the five columns of five squares with numbers in the squares. Because the player uses disposable paper cards, the player can also use an inked bingo marker or dauber in place of the chips referred to above. The bingo marker has a pad, about the size of a penny, which is pressed against the papers and leaves an impression indicating that a number has been called.

The bingo player carries accessories in addition to the chips, the wand, and the bingo marker. A pad of blank paper is useful to record information such as the "lucky number." If the player wins bingo on a lucky number, the player will win a big prize, and it is important for the player to write the number down so that it can be remembered. For the purpose of writing the number, a pencil should be carried by the player.

The need for all of these accessories requires organization.

BRIEF SUMMARY OF THE INVENTION

An objective of the present invention has been to provide for the organizing of bingo-playing accessories.

The objective of the present invention is attained by providing a quilted bag that is about 7 inches wide and 7 inches tall. The quilting imparts a stiffness to the material of the bag so that the bag can stand up on its own, leaving its interior easily accessible to the player. The quilted bag has interior pockets sized to retain the principal accessories such as the pad, the pencil, the wand and the bingo marker. The container of chips is carried on the bottom of the bag. The bag is normally open at the upper end but is provided with some way of closing it so that the bag and the accessories can be carried to and from the place for play without losing the contents.

BRIEF DESCRIPTION OF THE DRAWINGS

The several features and objectives of the present invention will become more readily apparent from the following detailed description taken in conjunction with the accompanying drawings in which.

DETAILED DESCRIPTION OF THE INVENTION

Figure 1:
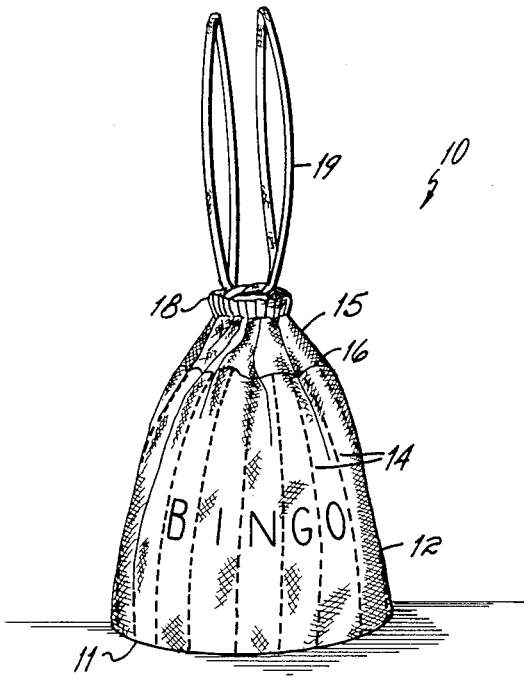
FIG. 1 is a perspective view of a closed bingo bag.
Figure 2:
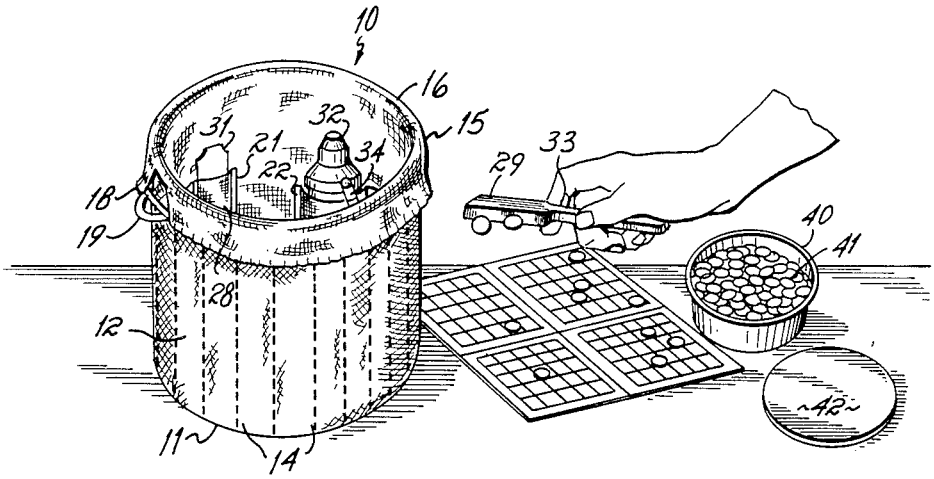
FIG. 2 is a perspective view of an open bingo bag illustrating some of the accessories.
Figure 3:
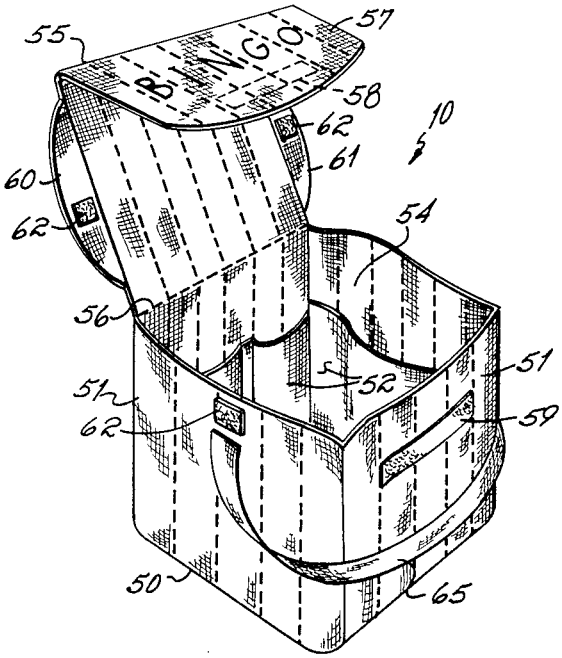
FIG. 3 is a perspective view of an alternative form of bingo bag.

A bingo bag 10 is shown in FIGS. 1 and 2. It has a circular bottom 11 and a generally cylindrical wall 12. The bottom and the cylindrical wall are formed of a quilted material. The quilted material is a laminate of two cotton fabrics with a batting in between to impart stiffness to it. The laminate is stitched in any pattern, as, for example, vertical columns 14, as shown in FIGS. 1 and 2.

A two-ply border 15 is sewed to the top edge 16 of the bag. The upper edge of the border is terminated in a hollow tubular casing 18 through which two drawstrings 19 pass to open and close the bag 10.

When the bag is opened as shown in FIG. 2, the border 15 can be folded down around the top edge portion of the bag to stiffen the top rim or opening of the bag and to increase the accessibility of the interior of the bag.

Figure 4:
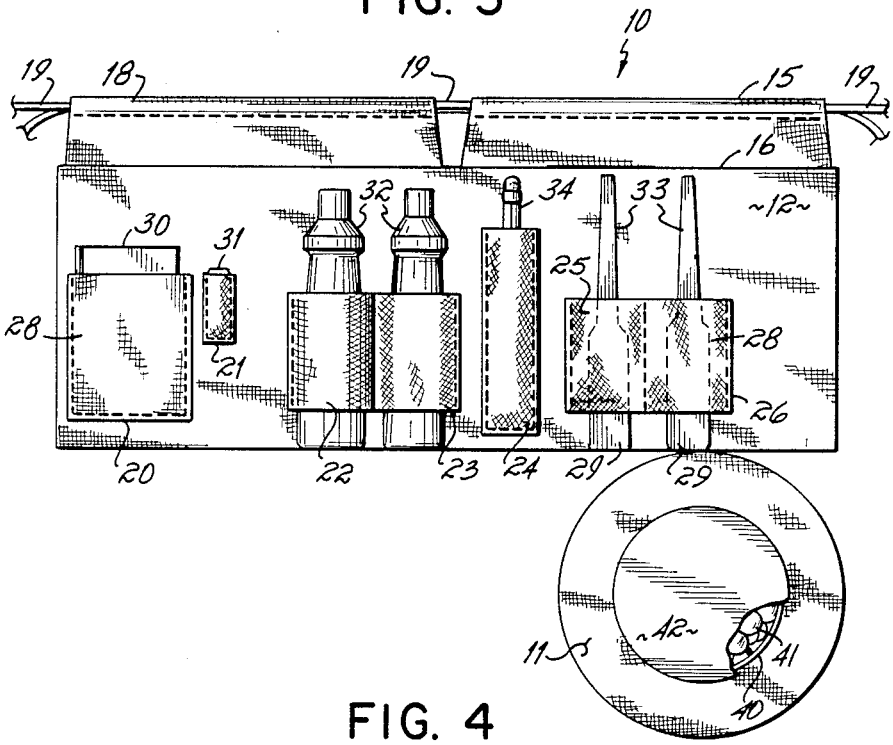
FIG. 4 is a developed view of the interior of the bingo bag.

The interior of the bag, best seen from FIGS. 2 and 4, has a series of pockets 20–26 formed by stitching pieces of fabric 28 to the interior of the bag. By way of example, pocket 20 contains a pad 30, pocket 21 contains ticket 31, pockets 22 and 23 contain a pair of inked bingo markers or daubers 32, a pencil 34 is in the elongated pocket 24, and the remaining pockets 25, 26 are for a pair of wands 33 each having a permanent magnet 29 in its end for sweeping up magnetic chips (see FIG. 2). The duplicate markers and wands permit two people to play out of one bingo bag.

A small container 40 contains a sufficient number of ferromagnetic chips 41 for playing the game. It has a lid 42 and is normally carried in the bottom of the bingo bag because it is too large for any of the pockets.

In an alternative form of the invention, the bingo bag 10 has a rectangular bottom 50 and side walls 51 which create a container that is rectangular in cross section. A series of pockets 52 of the size and usefulness of those depicted at 20–26 in FIG. 4 are stitched to the inside of the bingo bag. The bingo bag is quilted and has an open upper end 54. A lid 55 is hinged at 56 to one edge of the upper end. A flap 57 has a fastener element 58 cooperating with a fastener element 59 to form a hook and loop (Velcro) fastener. The lid also has two side flaps 60 and 61 with cooperating hook and loop fasteners 62. A carrying strap 65 may also be provided.

In both embodiments, the bag is formed of a three-ply quilted material. The two outside plies are preferably a cotton fabric and the inside ply is a batting that is held in the laminate by the quilting stitching.

In use, the player sits at the bingo table and sets the bingo bag 10 on the table. Referring to the circular embodiment of FIGS. 1 and 2, for example, the bag is opened and the border 15 is folded down to form a more rigid rim at the upper end of the bag. The bag exposes the accessories. Those that are needed for the particular game are brought out. The items can be returned from time to time if they are not in use in order to eliminate clutter from the bingo table.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A bingo bag comprising:

triple-ply quilt material comprised of a laminate of two fabrics with a batting therebetween and stitched together to form self-supporting vertical wall defining a hollow container that is open at its upper end, two-ply fabric material forming a hem about the upper end, drawstring means passing through the hem for closing the upper end, a separate piece of fabric stitched to the inner surface of said container vertical wall and forming a plurality of pockets, said pockets containing at least a magnet sweep for picking up bingo markers, and an ink bingo marker, a closed container of ferromagnetic bingo markers in the bottom of said bag.

2. A bingo bag as in claim 1, said two fabrics of said laminate each being cotton.

3. A bingo bag as in claim 1, further comprising:

a second, separate piece of fabric stitched to the inner surface of said container vertical wall and forming at least one further pocket.

4. A bingo bag comprising:

triple-ply quilt material comprised of a laminate of two fabrics with a batting therebetween and stitched together to form a self-supporting vertical wall defining a hollow container that is open at its upper end, said container having a flat bottom, a separate piece of fabric stitched to the inside of said container vertical wall to form a plurality of pockets to receive bingo accessories, two-ply fabric material forming a hem about the upper end, and drawstring means passing through the hem for closing the upper end of said bag, said bag being about seven inches in transverse dimension and about seven inches deep said bag occupying very little space on a bingo table and presenting accessories so that they are very accessible.

5. A bingo bag as in claim 4 in which said bag has a circular bottom.

6. A bingo bag as in claim 4 in which said bag has a rectangular bottom.

7. A bingo bag as in claim 4, said two fabrics of said laminate each being cotton.

8. A bingo bag as in claim 4, further comprising:

a second, separate piece of fabric stitched to the inner surface of said container vertical wall and forming at least one further pocket.

* * * * *